United States Patent [19]

Raynolds

[11] 3,981,807

[45] Sept. 21, 1976

[54] DURABLE TEXTILE TREATING ADDUCTS

[75] Inventor: Stuart Raynolds, Wilmington, Del.

[73] Assignee: E. I. Du Pont de Nemours and Company, Wilmington, Del.

[22] Filed: Sept. 27, 1973

[21] Appl. No.: 401,128

[52] U.S. Cl. ..... 252/8.8; 260/33.4 F; 260/849; 260/850; 260/853; 260/857 F; 260/857 PA; 260/857 PG; 260/858; 428/290

[51] Int. Cl.[2] ..... D06M 13/20; D01M 13/34

[58] Field of Search ..... 252/8.8, 8.6; 260/849, 260/850, 33.4 F; 428/290

[56] References Cited

UNITED STATES PATENTS

| | | | |
|---|---|---|---|
| 3,503,915 | 3/1970 | Peterson | 260/29.2 |
| 3,547,856 | 12/1970 | Tandy | 260/80.81 |
| 3,666,400 | 5/1972 | Lofton et al. | 8/115.6 |
| 3,721,700 | 3/1973 | Schuierer et al. | 260/471 C |
| 3,763,064 | 10/1973 | Soliday | 260/21 |
| 3,763,078 | 10/1973 | Aldrich | 260/33.4 F |

*Primary Examiner*—Donald E. Czaja
*Assistant Examiner*—Edward Woodberry

[57] ABSTRACT

Textile treating adducts having a chemically combined durabilizing segment with a melting point between about 100° and about 300°C. and which has a Solubility Parameter differing by at least one unit from the Solubility Parameter of the functional component of the adduct.

10 Claims, No Drawings

DURABLE TEXTILE TREATING ADDUCTS

BACKGROUND OF THE INVENTION

Textile fibers exhibit various shortcomings that can limit their use for certain applications. Wool has a tendency to shrink when laundered, cotton does not resist water penetration and has a tendency to crease and wrinkle. Synthetic fibers often are subject to build-up of static electricity and do not resist stains. Various finishes have been developed to alleviate these difficulties. These include water repellents, oil repellants, crease resistant finishes, oily soil washability promoters, fire-retardant finishes, anti-bacterial finishes and hand improvers.

While fabric finishes have performed well for their intended purpose, most of such finishes are intended for repetitive application after laundering or dry cleaning. Various techniques have been explored for imparting durability to textile finishes, such as products that react chemically with the fibers, or coating resins that are applied over the textile finish to encase the fiber and prevent removal of the finish. However, an entirely satisfactory, durable textile finishing adduct has heretofore not been available.

SUMMARY OF THE INVENTION

The present invention provides, in an adduct for application to a textile article for the purpose of improving the functional performance of the article, the improvement comprising including in the adduct and chemically bonding therein about from 5 to 50 weight percent of a durabilizing organic moiety having a melting point between about 100° and about 300°C. and a Solubility Parameter differing by at least one unit from the Solubility Parameter of the functional component of the adduct.

DETAILED DESCRIPTION OF THE INVENTION

The present invention relates to a wide variety of organic compositions used to modify properties in textiles. These include oil and water repellents, water repellants, soil release improvers, antistatic agents, durable press chemicals, hand builders or softeners, sewing lubricants and crease resistant finishes.

Oil and water repellency is generally conferred by polyfluorinated chemicals having at least 3 or 4 perfluorinated carbon atoms and exhibiting at least one trifluoromethyl end group. Compounds also having an active hydrogen as in an —OH, $—NH_2$, $$-\overset{|}{N}-H,\ -\overset{O}{\overset{\|}{C}}OH$$

or ester group can be used in the preparation of adducts of the present invention. Particularly satisfactory compounds of this type include $(CF_3)C_2FO(CF_2CF_2)_nCH_2CH_2OH$ where $n$ is 1 to 5;

$$C_8F_{17}SO_2\overset{R}{\overset{|}{N}}—CH_2CH_2OH$$

where R is a 1 to 3 carbon alkyl group; $R_f(CH_2)_mOH$ where $R_f$ is perfluoroalkyl of 3 to 17 carbon atoms and $m$ is an integer of from 1 to 12;

$$R_fCH_2\overset{X}{C}H(CH_2)_nOH$$

where $n$ is equal to or greater than 1, X is $—O_2C—$alkyl, $—(CH_2)_mOH$, $—(CH_2)_mO_2C—$alkyl, or OH, $R_f$ is perfluoroalkyl of 3 to 21 carbons and $m$ is 0 to 10; and $R_fCON(R)—(CH_2)_mOH$ where $R_f$ is perfluoroalkyl of 4 to 18 carbons, $m$ is an integer of from 2 to 6 and R is alkyl of 4 to 10 carbons.

Soil release properties are obtained by increasing the hydrophilicity of fiber surfaces, for example, by the use of polyethylene glycol or other surfactant material.

Anti-static properties are obtained by the application of hydrophilic materials and materials of ionic character. Chemicals such as methyldiethanolamine and ethoxylated dialkylamines serve effectively as anti-stats after quaternization and can be incorporated into adducts of the invention through the active hydrogen reactivity they possess.

Water repellency can be conferred by hydrocarbon rich materials such as alkyl alcohols of high molecular weight, such as stearyl alcohol.

Textile softeners, used to improve the "hand" or tactile impression of a textile material, include glycerol mono-fatty acid esters such as glycerol monostearate, fatty amides of the formula $$R—\overset{O}{\overset{\|}{C}}—N(C_2H_4OH)_2$$

where R is a long chain alkyl group, and polyglycol esters, e.g.

$$R\overset{O}{\overset{\|}{C}}O(C_2H_4O)_xOH$$

where $x$ is about 1 to 20 and R is a long chain alkyl group. Other textile improvers which can be used in this invention are fire-retarding agents and anti-bacterial finishes which contain active hydrogen atoms.

Some functional components described lack the necessary active hydrogen or other groups which allow them to combine to form adducts. These latter types of function improving compounds must be provided with the required reactive groups.

According to the present invention, a durabilizing component is incorporated into the molecular structure of the textile modifying adduct in an amount comprising about from 5–50 weight percent of the final product. The segments which perform the durabilizing role contain from one unit to about 10 repeating units. Preferably the durabilizing segment will contain one unit or 2 or 3 repeating units. The durabilizing segment, before it is reacted to form a textile adduct, should have a melting point of about from 100° to 300°C. It should also have a solubility parameter differing from the solubility parameter of the functional component of the adduct by at least one unit.

The solubility parameters of substances permit the determination of the likelihood of their mutual solubility. The solubility parameter for most materials of known chemical constitution can be either calculated or determined experimentally. Calculation can be made by using known values for the molar-attraction constant, F, for the more common groups in organic molecules according to the equation $$d = \frac{\Sigma F}{V},$$

where $V$ is the volume of one gram mole of the compound concerned and $\Sigma F$ is the sum of the molar attraction constants of the groups making up the compound. A discussion of the solubility parameter can be found in Small, J. Appl. Chem. 3, 71–80, Feb. (1953), which includes calculated and observed solubility parameters for representative polymers.

Values of the solubility parameters for still other common materials can be found in the Polymer Handbook, Editors J. Brandrup/ E. H. Immergut, published by Interscience Publishers, a division of John Wiley & Sons, New York, in Section IV, pages 341 to 368.

The durabilizing segment must exhibit a certain lack of compatability with the functional segment of the adduct, as indicated by the required difference in the solubility parameters of the durabilizing segment and the functional segment.

For compounds having more than one identifiable functional component, the solubility parameters for the various components are averaged. For example, $C_{12}H_{25}O(C_2H_4O)_{15}H$ can be a functional segment providing soil release qualities. The solubility parameter is a weighted average of the two dissimilar functional components. The literature value of the solubility parameter of $C_{12}H_{26}$ is 6.6, while polyethylene oxide has a solubility parameter of 8.4. On the basis of 169 parts of $C_{12}H_{25}$— and 677 parts of $—O(C_2H_4O)_{15}H$, the solubility parameter of the entire compound is $$\frac{(169 \times 6.6) + (677 \times 8.4)}{169 + 677} = 8.0$$

The melting point of the entity employed as durabilizing segment, when not chemically combined into the adduct, is about from 100° to 300°C. A melting point of this segment greater than 300°C. would make it impossible to properly apply the adduct to a textile substrate and obtain complete fiber coverage by flow and spreading of the molten adduct over the fibers. Melting points below 100°C. result in little or no durabilizing effect.

A wide variety of chemical entities can be used as durabilizing segments. Among those found especially useful are monomeric and oligomeric synthetic compounds such as those having linkages which form esters, amides, ureas, and urethanes. These materials generally have a solubility parameter higher than the other chemicals combined in textile treating adducts. Poly(ethylene glycol terephthalate), a particularly preferred durabilizing segment in oligomeric form, for example, has a solubility parameter of 10.7, while polyethylene glycol, frequently a major constituent of these adducts, has a solubility parameter of 8.4.

Esters which can be used include those of the formula $$HO\text{+}R'—O\overset{O}{\overset{\|}{C}}—R—\overset{O}{\overset{\|}{C}}—O\text{+}_nR''—OH$$

where $n$ is from 1 to about 10, where R′ and R″ are usually the same but may be different, and where R, R′ and R″ may be:

| R | R′ and R″ |
|---|---|
| 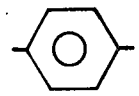 | 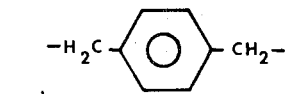 |
| 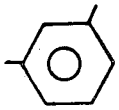 | 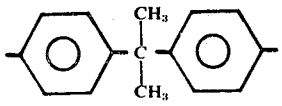 |
| $—(CH_2)_4—$ | 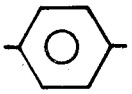 |

The durabilizing segment is present in an amount equal to about from 5 to 50% by weight of the adduct as a whole. Surprisingly, as little as 5% of the durabilizing segment can impart the properties of a cross-linked material of very high molecular weight to the whole adduct at room temperature, while the adduct may be said to show the properties of a material of moderate molecular weight at elevated temperature. Greater than 50% by weight of the adduct tends to depreciate the functional characteristics of the adduct. When a durabilizing segment having these properties is included in a textile adduct, the adduct exhibits a physical flexibility or plasticity at elevated temperatures of about 100° to 300°C., the temperature recommended for curing after application or during drying, and a "stiffening" or "unitizing" phenomenon at normal use temperatures of below about 100°C.

The different segments forming the textile treating adducts can be combined in any convenient way. Condensation reactions wherein no secondary products are formed, or elimination reactions in which atoms from each reactant are removed and recombined are convenient ways of forming the adducts. The functional and durabilizing segments used in preparing the adducts can have reactive atoms that permit the direct combination of the two components. The functional or durabilizing segments, for example, can be terminated with at least two groups reactive with active hydrogen, such as halides or isocyanate.

In the event that the durabilizing and functional segments of the adduct cannot be combined directly, a linking segment can be used, and can comprise about from 5 to 35% of the total weight of the adduct. Compounds useful in this linking function contain at least two groups reactive with active hydrogen. For example, diacyl halides can thus react by eliminating hydrogen halide, diesters can react by ester interchange, and diisocyanates can react by condensation. Another class of compounds useful as linking segments includes alkyl ethers derived from the familiar thermo-setting resin precursors formed from urea and formaldehyde, including those based on methylol urea, methylol melamine, methylol ethylene urea and methylol triazone. These compounds are characterized by at least two $$-\overset{|}{N}-CH_2-OR'$$

groupings where R′ is a 1 to 4 carbon alkyl group. They react with active hydrogen containing groups to eliminate R′—OH. With —OH containing reactants the other product is an ether, as for instance $$-\overset{|}{N}-CH_2-OCH_2CH_2OH$$

formed by reacting ethylene glycol. A preferred uniting segment of this kind of hexa(methoxymethyl)melamine which is hexafunctional, offering six uniting sites. Other uniting segments can be formed from the dialkoxymethyl derivatives of ethylene urea, propylene urea, 5-methylpropylene urea, 5-hydroxypropylene urea, 5,5-dimethylpropylene urea, methoxyethylene carbamate, 4-methoxy-5,5-dimethylpropylene urea, 4,5-dimethoxyethylene urea, uron, tetrahydrotriazone, etc.

The durabilizing segment and a functional segment of the present adducts can be combined by vinyl copolymerization. For example, a durabilizing segment such as di(hydroxyethyl)terephthalate can be reacted with a polymerizable monomer such as methacryloyl chloride to give a methacrylate ester as principal product. The product, containing a polymerizable acrylic double bond, can be copolymerized with a textile improving segment such as one of the familiar fluorinated acrylate or methacrylate esters. This product can be applied to synthetic textiles, polyester for instance, to confer oil and water repellency, and the durability of the repellency to repeated laundering and dry cleaning is greatly improved over that obtained by application of the fluoropolymer alone.

In one method for forming adducts of the invention, functional and durabilizing segments possessing active hydrogens in OH groups are reacted with linking segments which are alkyl ethers derived from amino-aldehyde condensates. The functional and durabilizing segments are linked by ether linkages with the elimination of an alcohol molecule for each link. Reaction can be carried out by heating the undiluted reactants or with an anhydrous solvent in the presence of an acid catalyst. Progress of the reaction can be followed by measuring the methanol produced.

Where the reaction does not produce a volatile byproduct, progress of the reaction can be followed by infrared, chromatographic or other well known instrumental techniques.

Although adduct segments may have a primary function to durabilize the adduct, to unite its segments or to promote its coverage over the substrate fibers, the segments can also have an effect on the kind and magnitude of the change that is made in the properties of the textile article. For example, a large proportion of ethylene oxide polymer acts through its hydrophilic property, both to control HLB as desired and also to promote textile washability.

Still further variation in properties of the present textile treating adducts is attained by including in the adducts compounds which, due to their high proportion of active hydrogen containing groups, serve to increase the average molecular weight of the adduct. Such compounds include ethylene glycol, very low molecular weight alkylene oxide polymers, as polyethylene oxide of a molecular weight of about 200 or less, ethylene urea, trimethylol propane, pentaerythritol, sorbitol and mannitol. Where an adduct formed by reacting hexa(methoxymethyl)melamine, a polyfluoroalcohol and a polyethylene glycol is found to be too high melting and intractable to be easily prepared and manipulated for use, inclusion of some higher molecular weight polyethylene glycol in the adduct will serve to lower both the average molecular weight and the melting point.

Adducts employing a durabilizing segment as taught herein can be applied to textile fabrics of cotton, wool, polyester, polyamide, polyacrylic and other materials. They have been found most useful in adducts for improving polyester and polyester cotton fabrics. Application can be made from aqueous or non-aqueous systems, and in widely varying loadings or amounts on the fabric. In some cases significant improvement in functional durability is attained with as little as 0.1% of the adduct on the fabric, based on dry fabric weight. In other cases as much as 4–5% may be required. Application can be made in any of the usual ways for applying treatments to textile fabrics, including dipping and wringing, spray coating, pad bath application and the like. The fabric is then dried, removing either water or solvent, and heated further at more elevated temperature to "cure" the coating on the fabric. The cure is not thought to promote a chemical reaction necessarily, but to induce flow and spreading of the adduct, causing it to cover the fiber surfaces more thoroughly. Drying temperature is not critical, and may be performed as a separate step or may be combined with the cure. Temperature of the cure can vary depending on the adduct, but is in the range of about 100° to 300°C. Ideally the cure is repeated during drying of a garment in a home dryer.

After application and curing, when the treated fibers are cooled, the coating assumes a tough, persistent character and cannot be readily removed from the substrate. The entire adduct is thus locked on, and is not readily removed by wear, washing or dry cleaning.

The adducts exhibit a durability after repeated washings or dry cleanings far greater than corresponding fiber treating adducts without a durabilizing segment.

These adducts may be applied singly to fabric or with other additives. They can be included in pad baths with other textile treating agents. In some cases an increased improvement in durability is achieved when the adducts containing durabilizing segments are applied in conjunction with a crease resistant resin, however the proportion of crease resistant resin employed in these cases is normally quite low, usually about 1 to 2% of the commercial resin (usually a 50% active ingredient product) on the fabric, based on dry fabric weight.

In the following examples there are illustrated a number of textile treating adducts employing a durabilizing segment according to the invention. The product is sometimes applied to test fabrics from aqueous solution or dispersion and sometimes from non-aqueous solvent solution. In all cases, after the desired amount of adduct is on the fabric, the test pieces are dried at elevated temperature, at least about 120°C., and cured by heating at a somewhat higher temperature, about 170°C. for about 1½ minutes. Time and temperature may be altered somewhat to suit the nature of the fabric, for instance a longer drying time may be required for a heavy fabric.

Where washes are applied to illustrate the durable character of treatments, they consist of a complete wash and spin dry cycle in a conventional automatic washing machine (Sears-Roebuck "Kenmore" Model 600) using about 18 gallons of water, 90.0 g. AATCC detergent No. 124 and a 4 lb. load of textile material. Washing temperature is about 60°C. and drying in a home dryer at about 85°C. The designation AATCC refers to the American Association of Textile Chemists and Colorists.

Where dry cleanings are applied, the fluid employed is perchloroethylene containing 0.06% water and 0.84% of Streets Detergent 886. The test fabric pieces are 8 × 10 inches and are loaded into a tumble jar, employing 75 to 175 grams of fabric with 10 ml. of fluid for each gram of fabric. The jar is tumbled at room temperature (20°–25°C.) for 20 minutes. The fabric pieces are spun in a centrifuge for 1 minute then dried for 5 minutes at about 70°C. in a tumble dryer. Each piece is then pressed for 15 seconds on each side with the face of the fabric in direct contact with the metal shoe of the press. The surface temperature of the metal shoe or plate may be at from 130° to 160°C. The specimens are then conditioned at room temperature for 4 hours before repellency and other test are performed.

EXAMPLE 1

Into a clean dry reaction vessel there were charged 209 parts of a mixture containing 18% ethylene glycol and 82% of

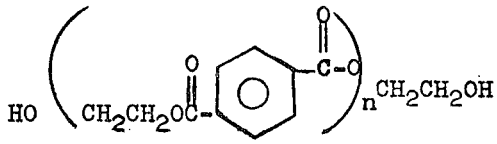

wherein $n$ is 1, 2 and 3 to provide an oligomer mixture with a melting point of from 160° to 185°C. The mixture was formed by reacting terephthalic acid with an excess of ethylene glycol as described by Bannerman and Magat on page 254 in "Polymer Processes", edited by Calvin Schildknecht and published by Interscience Publishers, Inc., New York. The mixture serves as the durabilizing segment of the adduct, and has a solubility parameter of 10.7. Then 1298 parts were added of polyethylene glycol monomethyl ether of 550 molecular weight and 789 parts of a product prepared by ethoxylating a mixture of straight chain alcohols containing about 60% dodecanol, 25% tetradecanol and 11% hexadecanol. This formed the functional component of the adduct, having a solubility parameter of 8.4 and 8.0 for the two parts of the component. The product contains about 15 ethylene oxide units for each mole of alcohol. The mixture was heated to 210° ± 2°C. and held at this temperature for ½ hour, then cooled to 135° ± 5°C. The temperature at this point was not allowed to go below 130°C. There were next added to the charge 357 parts of hexa(methoxymethyl)melamine, a linking component. The charge was then held at 135° ± 5°C. under reduced pressure of 20–40 Torr. for ½ hour to remove any moisture that might have been introduced. After adding nitrogen gas to the kettle to increase the pressure to one atmosphere, 3.17 parts of anhydrous p-toluenesulfonic acid were added and pressure reduced to 200 Torr. Initiation of reaction was indicated by evolution of methanol which was condensed and weighed. When reaction had started, pressure in the reactor was further reduced to 20–40 Torr., and the charge was heated to 190° ± 2°C. and held for 4 hours to complete reaction. Evolution of methanol ceased after 4 hours, indicating completion. The charge was cooled to about 70°C. and pressure in the vessel restored to atmospheric by adding nitrogen. Meanwhile a second vessel was charged with 9972 parts of water and 1.7 parts of sodium bicarbonate, and the completed reaction mass added to the aqueous bicarbonate. Solids content was about 20%. The product was suitable for treatment of textiles to improve their soil release properties. The adduct was applied to several types of fabric and tested for Soil Release quality by AATCC Test 130-1970 using burnt motor oil as soilant.

The tests were run at 4 application levels, with 2.0%, 1.0%, 0.5% and 0.25% of the 20% active ingredient product deposited on the fabric, based on dry fabric weight. Results are shown in Table I below.

TABLE I

| | Initial Rating | | | | | |
|---|---|---|---|---|---|---|
| | 65/35 Polyester/Cotton | 50/30/20 Polyester/Cotton/Nylon | After 10 Home Washes | | After 25 Home Washes | |
| Application Level | (a) | (b) | (a) | (b) | (a) | (b) |
| 2.0 | 3–4 | 3 | 3–4 | 3 | 3–4 | 3 |
| 1.0 | 3–4 | 3 | 3 | 3 | 2–3 | 3 |
| 0.5 | 3–4 | 3 | 3 | 3 | 1 | 3 |
| 0.25 | 3 | 2–3 | 2 | 3 | 1 | 3 |

EXAMPLE 2

A suitable reactor equipped with a reflux condenser and fractionation column was purged with nitrogen to eliminate air therefrom, and to it were added 22.71 parts of 1,4-dioxane and 12.0 parts of 1,1,2-trichloro-1,2,2-trifluoroethane. With good agitation 0.96 part of the same durabilizing component employed in Example 1 was added and dissolved by heating at 85°C. for about 30 minutes. To the charge were then added 5.37 parts of the functional component, a fluorinated alcohol $C_nF_{2n+1}CH_2CH_2OH$ having a calculated Solubility Parameter of 5.7, where $n$ is 3 to 14 and the alcohol is a mixture in which the major constituents are those where n is 6, 8 or 10; 2.3 parts of polyethylene glycol of M.W. 1000; 0.96 part of polyethylene glycol of M.W. 200; and 2.01 parts of hexa(methoxymethyl)melamine linking component previously dissolved in a mixture of 2.0 parts of 1,4-dioxane and 1.07 parts of 1,1,2-trichloro-1,2,2-trifluoroethane. The hexa(methoxymethyl)melamine was dry. Temperature of the charge was raised to 95°C. and water removed by azeotropic distillation until it ceased to appear in the distillate. The solvent removed was replaced. With the charge temperature at 95°C., 0.0077 part of p-toluenesulfonic acid monohydrate catalyst dissolved in 0.10 part of 1,4-dioxane was added. The charge was held under reflux while temperature at the top of the fractionating column dropped to 60°–65°C. as methanol of reaction was removed azeotropically with trichlorotrifluoroethane. As the last of the methanol of reaction was removed, the temperature at the top of the fractionating column rose to 78°C. Very close to the theoretical amount of methanol (94.2 parts) was removed from the reaction zone. The charge was then cooled to about 60°C. and 0.032 part of sodium bicarbonate in 1.03 parts of water was added to neutralize the acidic catalyst. The organic solvent material (1,4-dioxane and trichlorotrifluoroethane) was then removed by distillation under reduced (100–150 Torr.) pressure. When all of the solvent had been removed, 6.06 parts of isopropanol were added and the charge stirred for ½ hour at 65°–70°C. to form a clear solution. Water was then added to bring the solids content of the charge to 16.5%, about 28.0 parts being required. Before use the solution was filtered to remove extraneous solid material.

The product was applied to two different types of fabric at 5 application levels, and the treated cloth tested for Oil Repellency, Water Repellency and Soil Release. In each application there were included in the test bath sufficient "Aerotex" 23 Resin (a melamine-uron crease resistant resin) and Catalyst RB, the prescribed acidic catalyst, to leave 1% and 0.2% respectively on the fabric based on dry fabric weight. Application was made by dipping the cloth in an aqueous bath containing the prepared product and wringing to leave the indicated amount of the 16.5% active ingredient dispersion on the fabric, based on dry fabric weight.

The Oil Repellency Test used as AATCC Test Method No. 118-1966. The Water Repellency Test used was the Standard Spray Test, AATCC Standard Test Method 22-1964. The Soil Release test used was the Oil Stain Release Method, AATCC Test No. 130-1970. Results are shown in Table II below.

EXAMPLES 3–4

Preparation of durabilizing component:

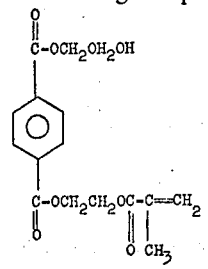

To a flask equipped with a reflux condenser and a receiver were charged 25.4 grams of dihydroxyethyl terephthalate, 100 ml. methylisobutyl ketone and 0.2 gram of paramethoxyphenol. Water was removed by azeotropic distillation with methylisobutyl ketone to a head temperature of 110°C. The charge in the flask was then cooled to 81°C. and slow, simultaneous addition begun of a first solution containing 10.4 grams of methacryloyl chloride in dry toluene and a second solution containing 10.6 grams of triethylamine in dry toluene. Temperature in the flask was maintained at 81°–83°C. during the addition which took 25 minutes. Agitation was then continued for 1 hour with the temperature at 70°C. Air was drawn through the flask by suction to inhibit polymerization of the product. After 10 minutes a volume of water equal to the volume of material in the flask was added to extract the triethylamine hydrochloride by-product of the reaction.

The bottom, aqueous layer was separated from the organic top layer containing the desired product, and the solvent methylisobutyl ketone was removed by distillation at about 50°C. The yield of product remaining in the flask was 43.5 grams.

The durabilizing component prepared above, having a Solubility Parameter of 10.7, was employed as comonomer with a fluoromonomer of the formula

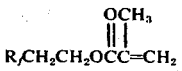

where $R_f$ is perfluorinated alkyl of 4 to 12 carbon atoms. $R_f$ is a mixture containing principally $C_6$, $C_8$ and $C_{10}$ compounds. This perfluoroalkylethyl methacrylate mix is prepared as disclosed in U.S. Pat. No. 3,378,609 from column 2, line 42 to column 3, line 52. The fluoromonomer serves as the functional component, and has a Solubility Parameter of 7.4. No separate linking group is necessary with these components.

Three polymerizations were performed using the following mixes of materials (Table III)

TABLE II

| Application Level % | Cloth A 100% Polyester Doubleknit | Cloth B | Oil Repellency Initial | Oil Repellency 5 Home Washes | Spray Test Initial | Spray Test 5 Home Washes | Soil Release Initial | Soil Release 5 Home Washes | Soil Release 10 Home Washes | Soil Release 15 Home Washes |
|---|---|---|---|---|---|---|---|---|---|---|
| 0.61 | A | | 2 | 1 | 70 | 70 | 2–3 | 1–2 | 2 | 1–2 |
| | | B | 3 | 3 | 70 | 70 | 3–4 | 4 | 3–4 | 3–4 |
| 1.22 | A | | 3–4 | 2 | 70 | 70 | 3–4 | 3–4 | 2–3 | 3–4 |
| | | B | 5 | 4 | 70 | 70 | 4 | 3–4 | 3–4 | 3–4 |
| 1.53 | A | | 4 | 2 | 70 | 70 | 3–4 | 3–4 | 2–3 | 3–4 |
| | | B | 5 | 4 | 70 | 70 | 3–4 | 3–4 | 3–4 | 3–4 |
| 1.83 | A | | 4 | 3 | 70 | 70 | 3–4 | 3–4 | 2–3 | 3–4 |
| | | B | 5 | 4 | 70 | 70 | 3–4 | 3–4 | 3–4 | 3–4 |
| 2.44 | A | | 5 | 4 | 70 | 70 | 3–4 | 3–4 | 3–4 | 3–4 |
| | | B | 5 | 5 | 70 | 70 | 3–4 | 4 | 3–4 | 3–4 |
| Untreated | | | 0 | 0 | 0 | 0 | 1 | 1 | 1 | 1 |

TABLE III

| Preparation | Control | Example 3 | 4 |
|---|---|---|---|
| Fluoromonomer | 20.0 | 18.0 | 16.0 |
| Durabilizing Component | — | 2.0 | 4.0 |
| 1,2-Difluoro-1,1,2,2-tetrachloroethane | 54 ml. | 54 ml. | 54 ml. |
| 1,1,2-trichloro-1,2,2-trifluoroethane | 26 ml. | 26 ml. | 26 ml. |
| Dodecyl mercaptan | 0.1 gram | 0.1 gram | 0.1 gram |
| α,α'-Azodiisobutyronitrile | 0.1 gram | 0.1 gram | 0.1 gram |

In each of the three preparations all of the materials except the α,α'-azodiisobutyronitrile initiator were charged to a flask and heated under reflux at 75°C. under a blanket of dry nitrogen for 30 minutes, then cooled to 70°C. while maintaining the blanket of nitrogen. One half of the catalyst was added in each case and the charge stirred at 70°C. for 3 hours, then the second half of the catalyst added. Each charge was stirred at 70°C. for an additional 12 hours, then filtered through several layers of cheesecloth and bottled. There were obtained in the various preparations: A-141.5 grams; B-141.0 grams; C-139 grams.

For each product solutions were prepared of about 12% concentration in 1,1,2-trichloro-1,2,2-trifluoroethane. The solutions were applied to three different kinds of cloth, 100% cotton, 65/35 polyester/cotton woven, and 100% polyester woven, so as to leave in one case 0.25% by weight and in a second case 0.50% by weight of the A, B and C adducts on the fiber after heating to remove the halogenated solvent. Application was made by padding and subsequent wringing to remove excess solution. The treated cloth pieces were tested for Oil Repellency using AATCC Test No. 118-1966 and for Water Repellency using Spray Test AATCC Test No. 22-1964. Results of the repellency tests are shown in Table IV below. In these tests oil repellency is improved as the number progresses from 0 to 10, and water repellency is improved as the number progresses from 0 to 100.

TABLE IV

| Copolymer | Repellency, Oil/Water: Initial | | After 1 Drycleaning | | After 5 Drycleanings | | After 5 Aqueous Launderings | |
|---|---|---|---|---|---|---|---|---|
| **Cloth - 65/35 Polyester/Cotton** | | | | | | | | |
| Example Conc.: | 0.25 | 0.50 | 0.25 | 0.50 | 0.25 | 0.50 | 0.25 | 0.50 |
| Control | 5/0 | 6/80 | 3/0 | 4/50 | 3/0 | 4/50 | 0/0 | 2/0 |
| 3 | 5/80 | 6/90 | 5/70 | 6/70 | 5/50 | 5/50 | 4/0 | 5/50 |
| 4 | 6/80 | 6/80 | 5/70 | 5/80 | 5/50 | 5/50 | 3/0 | 5/50 |
| **Cloth - 100% Cotton** | | | | | | | | |
| Example Conc.: | 0.25 | 0.50 | 0.25 | 0.50 | 0.25 | 0.50 | 0.25 | 0.50 |
| Control | 5/70 | 6/70 | 5/0 | 6/0 | 4/0 | 4/0 | 0/0 | 0/0 |
| 3 | 5/70 | 6/80 | 5/0 | 6/70 | 4/50 | 5/50 | 0/0 | 2/0 |
| 4 | 5/70 | 6/80 | 5/50 | 6/50 | 5/50 | 6/50 | 0/0 | 2/0 |
| **Cloth - 100% Polyester** | | | | | | | | |
| Example Conc.: | 0.25 | 0.50 | 0.25 | 0.50 | 0.25 | 0.50 | 0.25 | 0.50 |
| Control | 6/90 | 4/80 | 6/70 | 6/80 | 6/70 | 6/70 | 6/70 | 6/80 |
| 3 | 6/80 | 6/100 | 6/80 | 6/80 | 6/70 | 6/70 | 6/80 | 6/80 |
| 4 | 6/80 | 6/100 | 6/80 | 6/80 | 6/70 | 6/70 | 6/80 | 6/90 |

The improvement in durability of repellency of the adducts of the invention, containing durabilizing segments, over that exhibited by the control applications is readily seen. The influence of the type cloth used is also evident.

EXAMPLES 5–8

A set of 4 experiments was carried out, each employing the same fluoroalkyl alcohol used in Example 2 and each also employing as durabilizing segment the oligomeric mixture of ethylene glycol terephthalate monomer and dimers employed in Examples 1 and 2. The linking segment in each case was hexa(methoxymethyl)melamine. Various hydrophile-lipophile adjusting compounds were employed, as shown in Table V.

TABLE V

| Materials | Preparation of Textile Adducts: Example 5 | 6 | 7 | Control | 8 | Control |
|---|---|---|---|---|---|---|
| Stearyl alcohol | 30 g. | — | — | — | — | — |
| Polypropylene glycol, 1025 M.W. | — | 30 g. | — | — | — | — |
| Polytetramethylene glycol, 2770 M.W. | — | — | 30 g. | — | — | — |
| 1,4-Dioxane | 250 ml. | 250 ml. | 250 ml. | 250 ml. | 250 ml. | 250 ml. |
| 1,2-Difluoro-1,1,2,2-tetrachloroethane | 50 ml. | 50 ml. | 50 ml. | 50 ml. | 50 ml. | 50 ml. |
| Ethylene glycol terephthalate oligomer | 10 g. | 10 g. | 10 g. | — | 10 g. | — |
| Perfluoroalkyl alcohol | 70 g. | 70 g. | 70 g. | 70 g. | 100 g. | 100 g. |
| Hexa(methoxymethyl)melamine | 23.6 g. | 19.7 g. | 16.7 g. | 16.7 g. | 19.2 g. | 19.2 g. |
| p-Toluenesulfonic acid | 0.05 g. | 0.05 g. | 0.05 g. | 0.05 g. | 0.05 g. | 0.05 g. |

In each case all materials except the last two were charged to a flask and dried by azeotropic distillation.

After cooling to about 80°C. the last 2 ingredients were added and methanol of reaction removed by azeotropic distillation, the reaction being carried out at about 95°C. in the reactor until no further methanol distilled. Each charge was filtered while hot, a small amount of insoluble material being removed in each case. A solution of 0.2 g. sodium dicarbonate in 5 ml. of water was added to each reaction mixture to neutralize the p-toluenesulfonic acid catalyst, and the solvents were distilled out of each mixture at 100°–105°C., first at atmospheric pressure and finally under reduced pressure (2 Torr.).

Textile treating solutions were prepared for each of the 4 products, using 1,1,2-trichloro-1,2,2-trifluoroethane as solvent and adjusting the solute to about 12% in each case. Application was made to two types of polyester doubleknit fabric and at two levels. The prepared solutions were further diluted by adding 2 to 4 grams to 100 grams of 1,1,2-trichloro-1,2,2-trifluoroethane. The test cloths were dipped into the dilute solutions, then wrung out so as to hold in one case 2.5% and in the other case 4.0% of the prepared 12% solutions, then dried at 120°C. for about 1 minute and cured by heating in an oven at 170°C. for 1½ minutes. The treated cloths were tested for water repellency by Spray Test AATCC Standard Test Method 22-1964, and for oil repellency by AATCC Test Method No. 118-1966. Results are shown in Table VI. The control examples do not contain durabilizing segments but are otherwise idential to the immediately preceding Examples 7 and 8.

TABLE VI

| Ex. | Fabric | Initial Test Oil Repellency 2.5% | Initial Test Water Repellency 4.0% | After 1 Drycleaning Oil Repellency 2.5% | After 1 Drycleaning Water Repellency 4.0% | After 5 Drycleanings Oil Repellency 2.5% | After 5 Drycleanings Water Repellency 4.0% | After 5 Washes Oil Repellency 2.5% | After 5 Washes Water Repellency 4.0% | After 10 Washes Oil Repellency 2.5% | After 10 Washes Water Repellency 4.0% |
|---|---|---|---|---|---|---|---|---|---|---|---|
| 5 | a (100% Polyester) | 2/90 | 2/100 | 1/70 | 0/70 | 0/70 | 0/70 | 1/80 | 2/80 | 0/80 | 1/80 |
| | b (100% Polyester, heat set) | 2/90 | 2/100 | 0–1/70 | 1/70 | 0/70 | 0/0 | 2/80 | 2/90 | 1/70 | 1/80 |
| 6 | a | 4/70 | 4/70 | 4/70 | 4/70 | 4/70 | 1/70 | 5/70 | 6/70 | 5/70 | 6/70 |
| | b | 4/70 | 4/70 | 4/70 | 2/70 | 1–2/70 | 2/70 | 5–6/70 | 5/70 | 4–5/70 | 3–4/70 |
| 7 | a | 6/70 | 6/70 | 6/70 | 6/70 | 4/70 | 5/70 | 6–7/70 | 6/80 | 6/70 | 6/70 |
| | b | 6/70 | 6/70 | 6/70 | 6/70 | 2–3/70 | 4/70 | 6–7/70 | 6/70 | 6/70 | 6/70 |
| Control | a | 2/70 | 4/70 | 0/0 | 1–2/0 | 0/0 | 0/0 | 2/70 | 3/70 | 1/50 | 2/70 |
| | b | 0/70 | 1–2/70 | 0/70 | 0/30 | 0/0 | 0/0 | 0/70 | 0–1/70 | 0/70 | 0/70 |
| 8 | a | 5/90 | 6/80 | 6/70 | 6/70 | 5/70 | 6/70 | 6/80 | 6/90 | 6/80 | 6/90 |
| | b | 5–6/80 | 6/80 | 6/70 | 6/70 | 4/70 | 5/70 | 5/80 | 6/90 | 5/80 | 5–6/90 |
| Control | a | 0/80 | 3/80 | 1/70 | 3/70 | 0/0 | 0/70 | 2/70 | 5/80 | 2/70 | 4/70 |
| | b | 1/80 | 3/80 | 2/70 | 2/70 | 0/0 | 0/0 | 2/70 | 4/70 | 1/70 | 2/70 |

EXAMPLE 9

The durabilizing segment for the adduct of this example is a polyamide of the formula

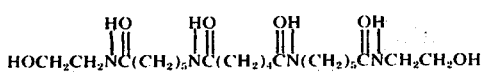

which is prepared as follows:

In a flask were charged 167.5 grams of the omega amine hydrochloride of caproic acid methyl ester in 600 ml. of methylene chloride at a solution temperature of 50°C. To the solution were added 102 grams of triethyl amine over ½ hour while temperature was maintained at 45°–50°C. followed by the addition of 90.5 grams of adipoyl chloride concurrently with an additional 101 grams of triethylamine. The second, concurrent addition, was made over ¾ hour while temperature was kept at near 50°C. The mixture was stirred an additional hour and allowed to cool overnight without agitation. A heavy precipitate of crystalline product was obtained. The slurry was extracted twice, first with 200 ml. of water then with 100 ml. of water both at 45°C. The aqueous extracts were discarded, and the organic layer was dried with anhydrous sodium sulfate, filtered to remove the sulfate and cooled to crystallize the product, which was then isolated by filtration and dried. There were obtained 177 grams of white powder having a melting point of 115°C. Infrared spectrometric analysis indicated a product of high purity, identified as

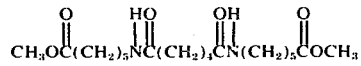

In a flask were then charged 216 grams of monoethanolamine and 800 ml. of tetrahydrofuran followed by 167 grams of the product prepared above. The charge was heated to reflux at 70°–72°C. for 4 hours. Infrared analysis of a small sample precipitated by drowning in acetone indicated only partial reaction, and the charge was refluxed another 4 hours. The charge was then cooled to 55°C. and 1000 ml. of acetone added, a white precipitate forming at once. The charge was cooled to 5°C. and the solid isolated by filtration. It was washed with several portions of acetone, then with 300 ml. of 1,2-difluoro-1,1,2,2-tetrachloroethane and dried in air for several hours and finally at 100°C. for 8 hours. There were obtained 128 grams of white powder having a melting point of 185°C. From the original reaction filtrate there were isolated by evaporation, filtration, washing and drying an additional 20 grams of impure product melting at 170°C.

Infrared analysis of the product indicated a structure consistent with that of the durabilizing polyamide component as set forth above. It has a Solubility Parameter of 8.7.

An adduct for textile treatment was prepared by charging to a flask 4.1 grams of the product of durabilizing polyamide, 47 grams of the same fluoroalcohol employed in Example 2, 15 grams of hexa(methoxymethyl)melamine, 20 grams of polyethylene glycol of 1000 molecular weight, 0.057 grams of p-toluenesulfonic acid, 100 ml. of dimethylacetamide and 30 ml. of 1,2-difluoro-1,1,2,2-tetrachloroethane. The charge was heated to reflux, and 5.1 grams of methanol was recovered by azeotropic distillation. Reaction time was 2½ hours. The acidity was neutralized by adding 5 ml. of 3% aqueous sodium bicarbonate solution, and the solvents were removed by distilling under reduced pressure at 80°C. Weight of the syrupy product was 81 grams. A solution was prepared containing proportionally 12.1 grams of the product, 12.0 grams of isopropyl alcohol and 75.9 grams of water, and cloth samples treated to confer oil and water repellency. In each case the application was made by dipping the cloth into a water dispersion of the product and the cloth wrung out so as to leave 2.5% of the 12.1% product solution on the fabric, based on dry fabric weight. The cloth was then dried at 120°C. and cured at 170°C. for 1½ minutes. Oil and water repellency tests were performed as in the previous examples. Results are shown in Table VII below.

TABLE VII

| Cloth | Oil Repellency With Resin | Oil Repellency Without Resin | | Water Repellency With Resin | Water Repellency Without Resin |
|---|---|---|---|---|---|
| Polyester doubleknit | 3–4 | 4 | Initial | 70 | 70 |
| | 2–3 | 2 | After 5 Washes | 70 | 70 |
| Nylon taffeta | 2 | 1 | Initial | 70 | 70 |
| | 0–1 | 0 | After 5 Washes | 70 | 70 |
| Untreated (both types of cloth) | 0 | 0 | | 0 | 0 |

As indicated, applications were made both with and without resin. The resin, when used, was "Aerotex" 23 Resin, employed in a quantity so as to leave 1% of the resin product and 0.2% catalyst RB on the fabric, based on dry fabric weight.

EXAMPLE 10

This example employs a durabilizing segment prepared from methylenebis(4-phenylisocyanate), and having a Solubility Parameter of 9.8.

A flask was charged with 6.2 grams of ethylene glycol, 0.05 ml. of dibutyltindilaurate and 50 mls. of methylisobutyl ketone. Into this agitated charge held at about 60°C. was dripped a solution containing 29.1 grams of $OCN—CH_2—(CH_2)_{34}CH_2NCO$ in 25 mls. of methylisobutyl ketone. The addition consumed 3 hours. The mixture was then added dropwise over 3 hours to a mixture containing 25.0 grams of methylenebis(4-phenylisocyanate), 50 mls. of methylisobutyl ketone and 0.05 g. dibutyltindilaurate. The charge became viscous, and an additional 50 ml. methylisobutyl ketone was added and the charge heated to 60°C. Solutions were next prepared in 2 dropping funnels for addition to the reacted charge. Funnel 1 contained 50.0 grams of polyethylene glycol of 1000 M.W. and sufficient methylisobutyl ketone to make the total volume 125 ml. Funnel 2 contained 55.0 g. of polyethylene glycol monomethyl ether of 550 M.W. and methylisobutyl ketone to make a total volume volume of 125 ml. These two elements made up the functional component of the adduct, and have a Solubility Parameter of 8.4. With temperature in the reaction flask at about 60°C., addition of material from the first funnel was begun, the charge in the flask becoming more and more viscous. Just 50 ml. of solution was added. Next 75 ml. of solution from the second funnel was added. Methylisobutyl ketone was removed by vacuum distillation, but the charge began to gel, so distillation was stopped.

A textile treating solution was prepared from the above product. It contained 8% active ingredient product in 1:1 volume of toluene:acetone. The product was applied to 65/35 polyester/cotton knit fabric and to 50/30/20 polyester/cotton/nylon at levels of 10% and 5% of the 8% solution on the cloth based on dry fabric weight. The treated cloth was dried for 1 minute at 120°C. then cured for 1 minute at 170°C. The treated cloth samples were tested for Soil Release by AATCC Test Method No. 130-1970, using burnt motor oil as soilant. Results are shown in Table VIII below.

TABLE VIII

| | Soil Release 65/35 Polyester/Cotton | Soil Release 50/30/20 Polyester/Cotton/Nylon |
|---|---|---|
| Initially | 2–3 | 3–4 |
| After 1 Drycleaning | 2–3 | 2–3 |
| After 5 Drycleanings | 1 | 2–3 |
| After 5 Home Washes | 2–3 | 2–3 |
| After 10 Home Washes | 3–4 | 2–3 |

I claim:

1. In an adduct for application to a textile article for the purpose of improving the functional performance of the article, the improvement consisting essentially of including in the adduct and chemically bonding therein about from 5 to 50 weight percent of a durabilizing organic moiety having a melting point between about 100° and about 300°C. and a Solubility Parameter differing by at least one unit from the Solubility Parameter of the functional component of the adduct.

2. An adduct of claim 1 further comprising about from 5 to 35 percent by weight of the adduct of a linking segment having at least two groups reactive with active hydrogen.

3. An adduct of claim 1 wherein the durabilizing component has from 1 to 10 repeating units.

4. An adduct of claim 1 further comprising polyethylene glycol.

5. An adduct of claim 1 wherein the durabilizing organic moiety is selected from polyesters, polyurethanes and polyamides of from 1 to 10 repeating units.

6. An adduct of claim 1 wherein the functional component thereof imparts at least one property selected from oil and water repellency, soil release, antistatic properties, durable press, and water repellency.

7. An adduct of claim 6 wherein the functional component of the adduct comprises at least 15 weight percent of the adduct and consists essentially of a polyfluorinated oil and water repellent.

8. An adduct of claim 7 wherein the functional component is derived from an ethoxylated long chain aliphatic alcohol.

9. An adduct of claim 1 formed by bringing into contact under reaction conditions oligomeric ethylene glycol terephthalate hexa(methoxymethyl)melamine, polyethylene glycol having a molecular weight of from 550 to 2,000 and $R—O(C_2H_4O)_nH$ wherein R is a straight chain alkyl group of from 10 to 16 carbon atoms and $n$ has from 10 to 20.

10. An adduct of claim 1 prepared by bringing into contact under reaction conditions oligomeric ethylene glycol terephthalate hexa(methoxymethyl)melamine, $C_nF_{2n+1}CH_2CH_2OH$ where n is from 4 to 14 and polyethylene glycol having a molecular weight of from 200 to 2,000.

* * * * *